US007073895B2

(12) United States Patent
Ito

(10) Patent No.: US 7,073,895 B2
(45) Date of Patent: Jul. 11, 2006

(54) INK-JET PRINTHEAD AND METHOD FOR PRODUCING THE SAME

(75) Inventor: Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 114 days.

(21) Appl. No.: 10/650,775

(22) Filed: Aug. 29, 2003

(65) Prior Publication Data

US 2004/0090499 A1 May 13, 2004

(30) Foreign Application Priority Data

Sep. 27, 2002 (JP) ..... 2002-282392

(51) Int. Cl.
*B41J 2/045* (2006.01)

(52) U.S. Cl. ..... 347/72; 347/68; 347/71

(58) Field of Classification Search ..... 347/68–73; 310/328

See application file for complete search history.

(56) References Cited

U.S. PATENT DOCUMENTS

| | | | | |
|---|---|---|---|---|
| 5,087,930 | A * | 2/1992 | Roy et al. | 347/85 |
| 5,643,379 | A * | 7/1997 | Takeuchi et al. | 156/89.12 |
| 5,912,526 | A * | 6/1999 | Okawa et al. | 310/328 |
| 5,956,059 | A | 9/1999 | Usui | |
| 6,113,225 | A * | 9/2000 | Miyata et al. | 347/70 |
| 6,142,615 | A * | 11/2000 | Qiu et al. | 347/70 |
| 6,198,203 | B1 | 3/2001 | Hotomi | |
| 6,298,214 | B1 | 10/2001 | Koga | 399/322 |
| 6,350,020 | B1 | 2/2002 | Yoshimura | |
| 6,441,537 | B1 | 8/2002 | Takeuchi et al. | |
| 6,575,565 | B1 | 6/2003 | Isono et al. | |
| 2001/0020968 | A1 | 9/2001 | Isono et al. | |

FOREIGN PATENT DOCUMENTS

| | | |
|---|---|---|
| JP | 62-249835 | 10/1987 |
| JP | A 8-169111 | 7/1996 |
| JP | A 2001-162796 | 6/2001 |
| JP | A 2001-246744 | 9/2001 |
| JP | A 2001-260349 | 9/2001 |
| WO | WO 01/54851 A2 * | 8/2001 |

* cited by examiner

*Primary Examiner*—Manish Shah
*Assistant Examiner*—Geoffrey S. Mruk
(74) *Attorney, Agent, or Firm*—Oliff & Berridge, PLC

(57) ABSTRACT

An ink-jet printhead according to an aspect of the invention includes a cavity unit and a plate type piezoelectric actuator. The cavity unit has two rows of staggered nozzle orifices and two rows of staggered pressure chambers being in fluid communication with respective ones of the nozzle orifices. The piezoelectric actuator is a laminate of a plurality of piezoelectric sheets obtained by sintering green sheets of ferroelectric material having obtuse or rounded corners. The piezoelectric actuator is fixed onto the cavity unit to seal the pressure chambers. The piezoelectric actuator having obtuse or rounded corners are securely bonded to the cavity unit.

13 Claims, 8 Drawing Sheets

INK-JET PRINTHEAD AND METHOD FOR PRODUCING THE SAME

BACKGROUND OF THE INVENTION

The present invention relates to an ink-jet printhead and a method for producing the same, and more particularly to a laminated ink-jet printhead provided with a piezoelectric actuator and a method for producing the same.

U.S. patent application Publication Ser. No. U.S. 2001/0,020,968 A1 discloses an on demand type ink-jet printhead provided with a piezoelectric actuator. The ink-jet printhead disclosed in the above mentioned publication includes a multi-layer cavity unit that has a plurality of nozzles and a plurality of pressure chambers being in fluid communication with respective ones of the nozzles. The pressure chambers are formed in the uppermost layer of the cavity unit with the upper sides thereof being opened.

The piezoelectric actuator is fixed on the top surface of the cavity unit so as to close or seal the upper sides of the pressure chambers. The piezoelectric actuator includes a plurality of active portions. Each active portions can selectively press one of the pressure chambers to eject ink filled therein through the corresponding nozzle.

The piezoelectric actuator is produced by laminating a plurality of rectangular green sheets and sintering the same. The sintered piezoelectric actuator is then placed on the top surface of the cavity unit with an adhesive layer therebetween and pressed against the cavity unit to be fixed thereon.

The four corners of the rectangular green sheets, however, often become warped in the thickness direction of the green sheets during the sintering process. FIG. 1A schematically shows an example of such sintered green sheets, or piezoelectric actuator 2, having warped corners. As shown in FIG. 1B, such warped corners cause a gap to be formed between the cavity unit 1 and the piezoelectric actuator 2 fixed thereon, which gap may cause a leak of ink from the pressure chambers. Further, the piezoelectric actuator 2 may break at the warped corners when it is pressed against the cavity unit 1 to be fixed on it.

U.S. Pat. No. 5,956,059 discloses an ink-jet printhead including a channel forming member made of ceramic sheets. Ceramic green sheets formed with cavities are stacked and sintered without any adhesive layers to produce a channel forming member having a plurality of pressure generating chambers and a common ink chamber.

Then, green sheets of piezoelectric material are adhered onto the top surface of the channel forming member to correspond to the respective pressure generating chambers, and sintered together with the channel forming member. With this, piezoelectric vibration plates are formed on the top surface of the channel forming member.

It should be noted that, the channel forming member has high mechanical strength at the time of the second sintering process for forming the piezoelectric vibration plates thereon since the channel forming member has been already sintered in advance of the second sintering process. Therefore, the channel forming member hardly warps as a whole during the second sintering process due to the shrinkage of the piezoelectric vibration plates.

In the above-mentioned ink-jet printhead, however, the rectangular ceramic sheets constituting the channel forming member shrink every time these sheets are sintered, once for forming the channel forming member and once for forming the piezoelectric vibration plates. Such repeated shrinkage of the ceramic sheets causes the corners thereof to become considerably warped.

Thus, there is a need for an ink-jet printhead by which the above mentioned problems do not arise.

SUMMARY OF THE INVENTION

The present invention is advantageous in that an ink-jet printhead and a method for producing the same that satisfy the above mentioned need is provided.

An ink-jet printhead according to an aspect of the invention includes a cavity unit and a plate type piezoelectric actuator. The cavity unit has a plurality of nozzle orifices and a plurality of pressure chambers for storing ink. The pressure chambers are in fluid communication with the respective nozzle orifices. The piezoelectric actuator, which may have a rectangular shape, is overlaid on the cavity unit so as to selectively apply pressure to the pressure chambers to eject ink from the respective nozzle orifice. Corners of the piezoelectric actuator are shaped into a non-acute angle form, such as one of an obtuse form and a rounded convex form. Such a non-acute angle form prevents the corners of the piezoelectric actuator from becoming warped during the sintering process of the piezoelectric actuator. Therefore, the piezoelectric actuator can be overlaid on the cavity unit without forming a gap therebetween or breaking the corners thereof.

In some cases, the cavity unit is formed with openings at one face thereof to define the pressure chambers, and the piezoelectric actuator is overlaid on the one face of the cavity unit to seal the openings. The piezoelectric actuator may be fixed to the above-mentioned face of the cavity unit by means of a thermosetting adhesive.

Optionally, the piezoelectric actuator may include a laminate of a plurality of piezoelectric sheets. Corners of each piezoelectric sheet are shaped into the obtuse form or the round convex form. The piezoelectric actuator may further include an insulative sheet placed on the top of the laminate of piezoelectric sheets, which insulative sheet has corners shaped into the obtuse form or the round convex form. The insulative sheet may be made of the same material as the piezoelectric sheets.

Optionally, the plurality of nozzle orifices are arranged in a row, and the plurality of pressure chambers are arranged in a row. Further, the piezoelectric actuator has a plurality of active portions aligned with the respective ones of the pressure chambers.

Further optionally, the piezoelectric actuator is a laminate of first and second electrode layers and a piezoelectric sheet interposed between the first and second electrode layers. The first electrode layer includes a plurality of separate electrodes that define together with the second electrode layer the plurality of active portions in the piezoelectric sheet. Corners of the piezoelectric sheet are shaped into the obtuse form or the rounded convex form.

A method for producing an ink-jet printhead according to an aspect of the invention includes the steps of preparing a cavity unit having a nozzle orifice and a pressure chamber for storing ink and being in fluid communication with the nozzle orifice, preparing a piezoelectric actuator, and fixing the piezoelectric actuator onto the cavity unit to allow the piezoelectric actuator to press the pressure chamber to eject ink from the nozzle orifice. The step of preparing the piezoelectric actuator includes the steps of preparing a green sheet from a ferroelectric material, shaping corners of the green sheet into a non-acute angle form, and sintering the green sheet to obtain a piezoelectric sheet. The step of shaping corners of the green sheet is carried out before the step of sintering the green sheet. Therefore, the corners of the green sheet does not become warped and allow the piezoelectric actuator to be fixed onto the cavity unit without forming a gap therebetween.

Optionally, the method further includes a step of forming electrodes on the green sheet. This step may be carried out before the step of shaping the corners of the green sheet or after the step of shaping the corners of the green sheet.

Optionally, the cavity unit is prepared such that an opening is formed at one face of the cavity unit to define the pressure chamber, and the piezoelectric actuator is fixed on the cavity unit so as to seal the opening. Note that the piezoelectric actuator may be fixed to the cavity unit by means of thermosetting adhesive.

Optionally, the green sheet is prepared into a rectangular shape, and four corners of the green sheet are shaped into one of an obtuse form and a rounded convex form.

A method for producing an ink-jet printhead according to another aspect of the invention includes the steps of preparing a cavity unit, preparing a piezoelectric actuator, and fixing the piezoelectric actuator onto the cavity unit to allow the piezoelectric actuator to selectively press the pressure chambers to eject the ink from the respective nozzle orifice. The cavity unit has a plurality of nozzle orifices and a pressure chambers for storing ink. The pressure chambers are in fluid communication with the respective nozzle orifices. The step of preparing the piezoelectric actuator further includes the steps of preparing a plurality of first green sheets from a ferroelectric material, each being provided with a first electrode layer on one side thereof, preparing a plurality of second green sheets from a ferroelectric material, each being provided with a second electrode layer on one side thereof, shaping corners of the first and second green sheets into a non-acute angle form, stacking the first and second green sheets alternately to sandwich therebetween the separate electrodes or the common electrodes, and sintering the stack of the first and second green sheets. The step of shaping corners of the first and second green sheets is carried out before the step of sintering the stack of the first and second green sheets.

Optionally, the plurality of nozzle orifices are arranged in a row, and the plurality of pressure chambers are arranged in a row. The piezoelectric actuator has a plurality of active portions that are defined between each of the separate electrode and a corresponding one of the common electrodes.

The piezoelectric actuator may be fixed on the cavity unit such that the active portions are aligned with the respective pressure chambers of the cavity unit. In this case, the piezoelectric actuator may be fixed to the cavity unit by means of a thermosetting adhesive.

Optionally, the first and second green sheets are prepared into a rectangular shape, and four corners of the first and second green sheets are shaped into one of the obtuse form and rounded convex form.

BRIEF DESCRIPTION OF THE ACCOMPANYING DRAWINGS

DETAILED DESCRIPTION OF THE EMBODIMENTS

Hereinafter, an embodiment of the invention will be described with reference to the accompanying drawings.

Figure 1A:
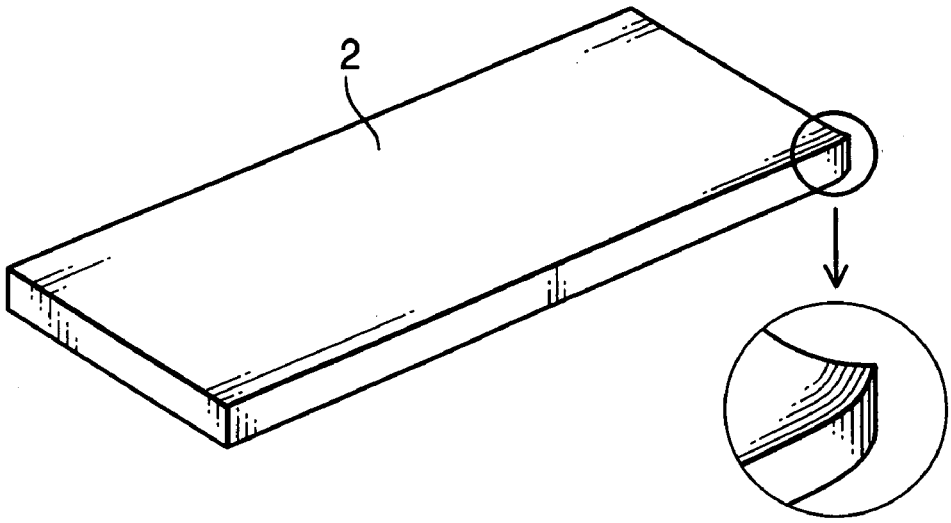
FIG.1A RELATED ART
FIG. 1A illustrates a conventional piezoelectric actuator having a warped corner.
Figure 1B:
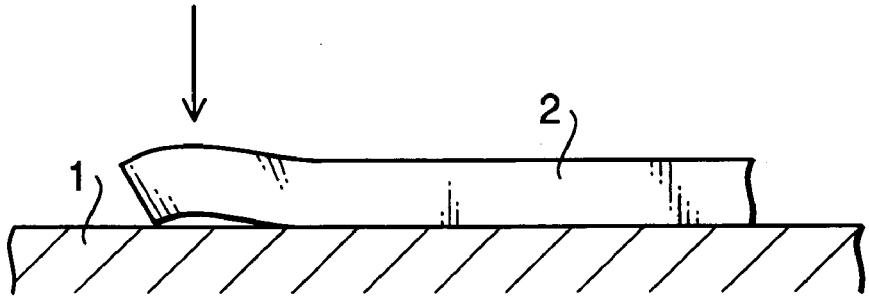
FIG.1B RELATED ART
FIG. 1B illustrates the piezoelectric actuator of FIG. 1A being attached on a cavity unit.
Figure 2:
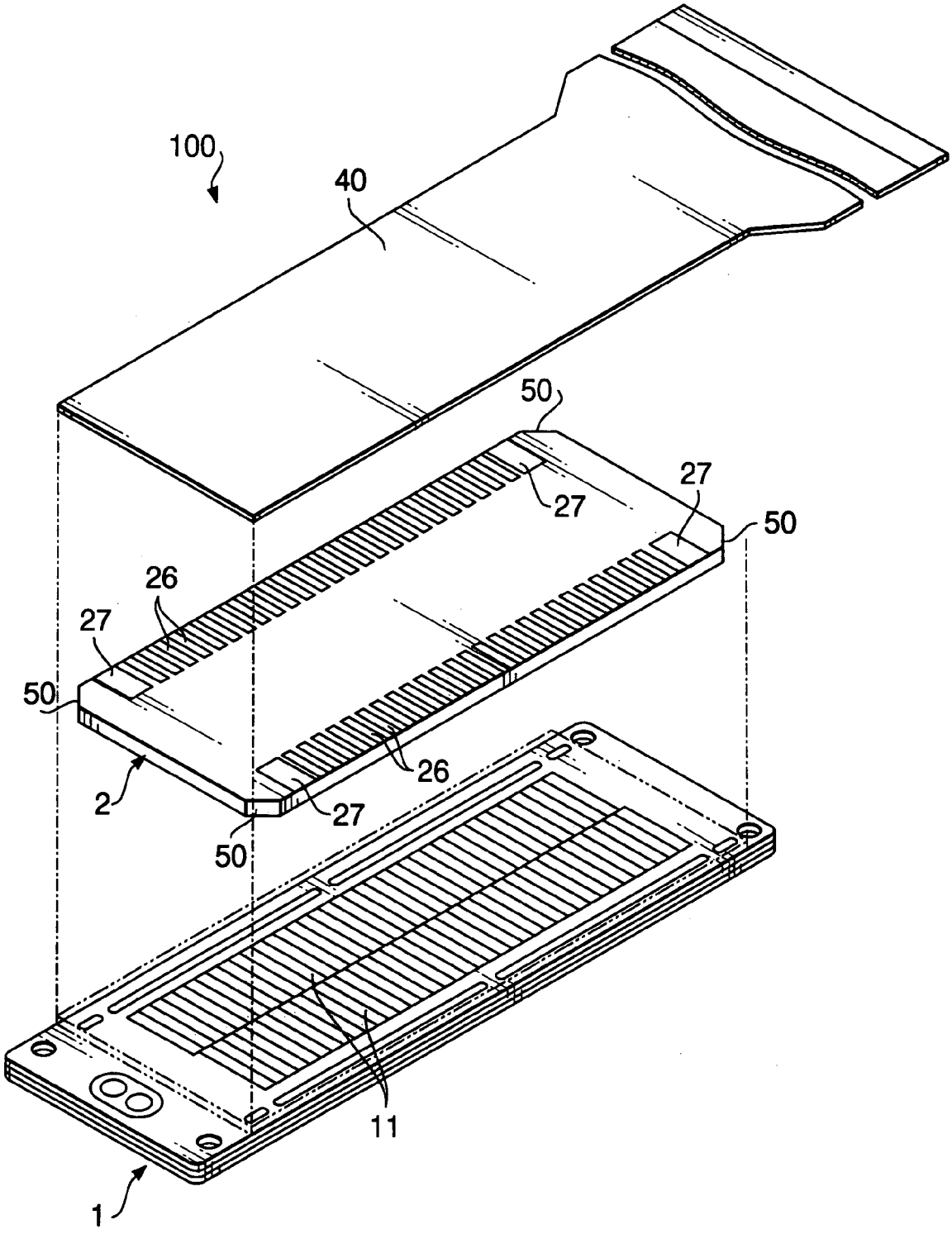
FIG. 2 is an exploded perspective view of an piezoelectric type ink-jet printhead according to an embodiment of the invention.

FIG. 2 is an exploded perspective view of an piezoelectric type ink-jet printhead 100 according to the embodiment of the invention. As shown in FIG. 1, the ink-jet printhead 100 includes a cavity unit 1, a plate type piezoelectric actuator 2 fixed on the cavity unit 1, and a flexible flat cable 40. The flexible flat cable 40 is overlaid and connected with the top surface of the piezoelectric actuator 2 to establish connection between the piezoelectric actuator 2 and external equipment (not shown). The cavity unit 1 is configured so as to eject ink downwards in FIG. 2 from a plurality of nozzle orifices (see FIG. 3) formed at the undersurface thereof.

Figure 3:
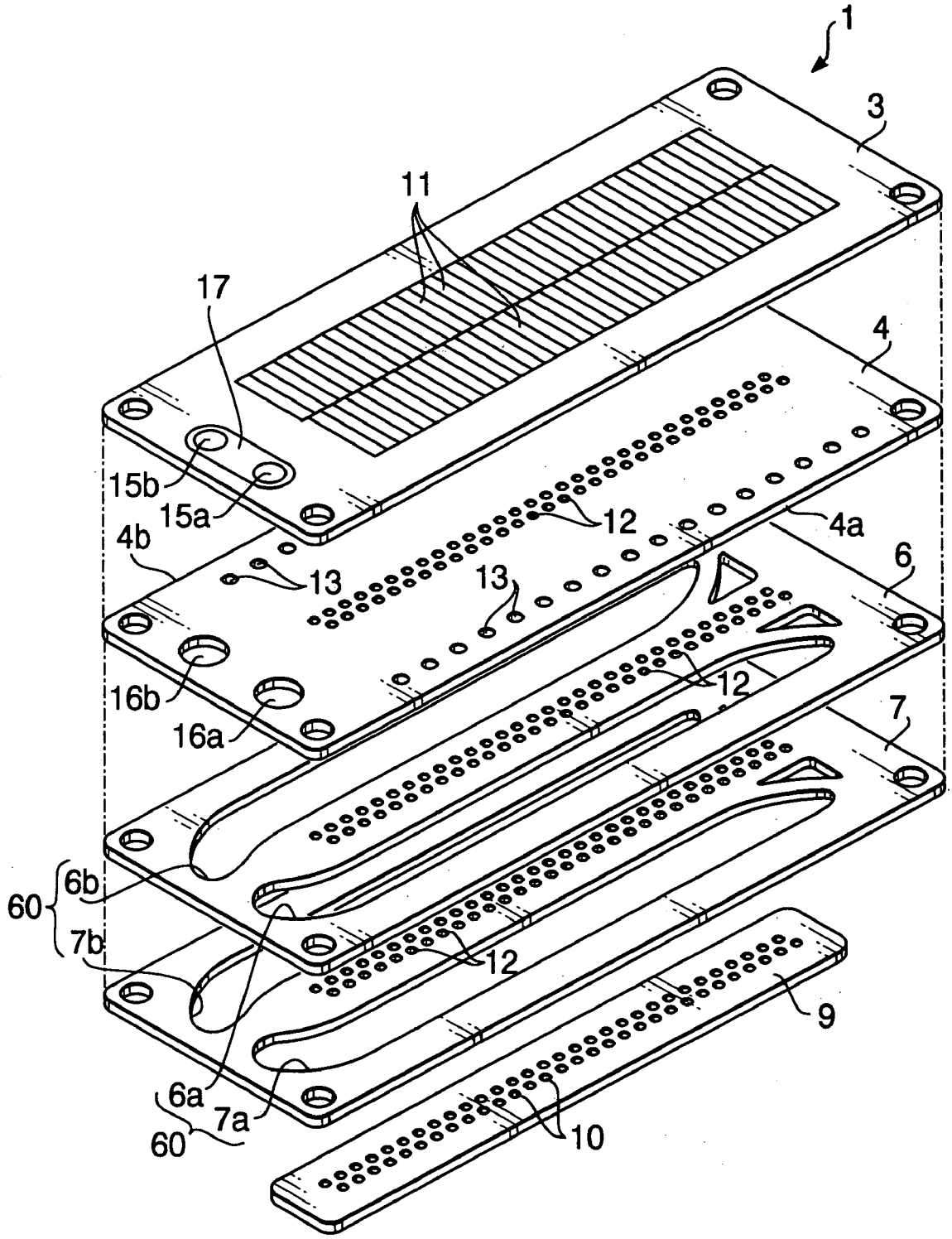
FIG. 3 is an exploded perspective view of a cavity unit of the ink-jet printhead shown in FIG. 2.

FIG. 3 is an exploded perspective view of the cavity unit 1 of the ink-jet printhead shown in FIG. 1. The cavity unit 1 is obtained by laminating a plurality of plates. That is, a cavity plate 3, a base plate 4, two manifold plates 6 and 7, and a nozzle plate 9 are laminated in this order and bonded to each other. In the present embodiment, the cavity plate 3, the base plate 4 and the two manifold plates 6 and 7 are made of 42% nickel alloy steel to a thickness of about 50 μm to about 150 Mm. The nozzle plate 9 is made of synthetic resin such as polyimide resin. It should be noted, however, that the nozzle plate 9 may be also made of metal sheets. These plates (3, 4, 6, 7 and 9) are provided with openings and recesses, for forming chambers, and fluid channels by means of electrolytic etching, excimer laser machining, plasma etching, or the like.

The nozzle plate 9 is provided with two rows of staggered nozzle orifices 10 for ejecting ink. Each row of nozzle orifices 10 extends in the longitudinal direction of the nozzle plate 9 and the nozzle orifices 10 are located at regular intervals in each row. Each nozzle orifice 10 has a minute diameter of about 25 μm in the present embodiment.

The cavity plate 3 is provided with two rows of staggered pressure chambers 11. The pressure chambers 11 are arranged in association with the nozzle orifices 10 of the nozzle plate 9.

Figure 4:
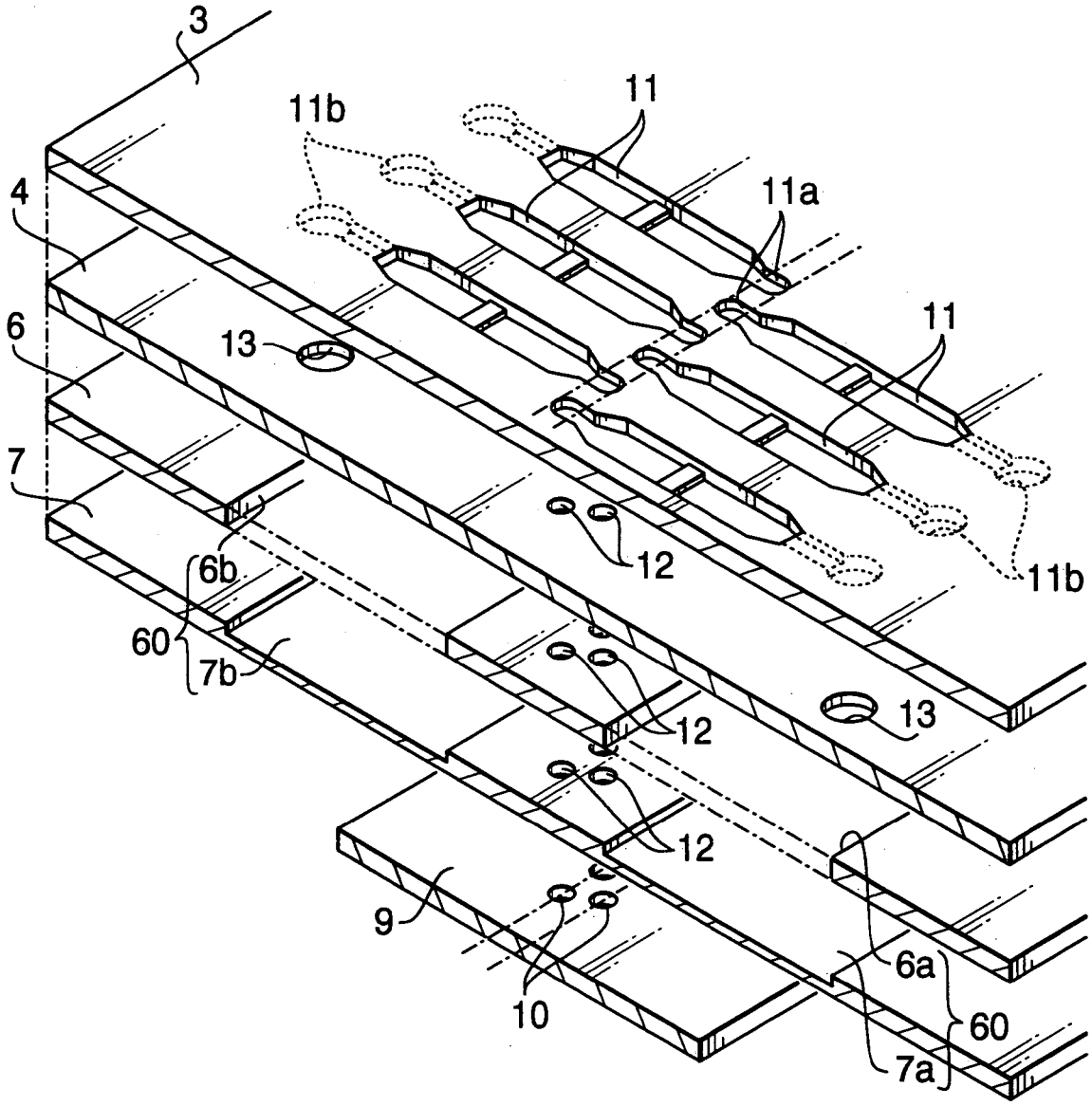
FIG. 4 is an enlarged view of a part of the cavity unit shown in FIG. 3.
Figure 5:
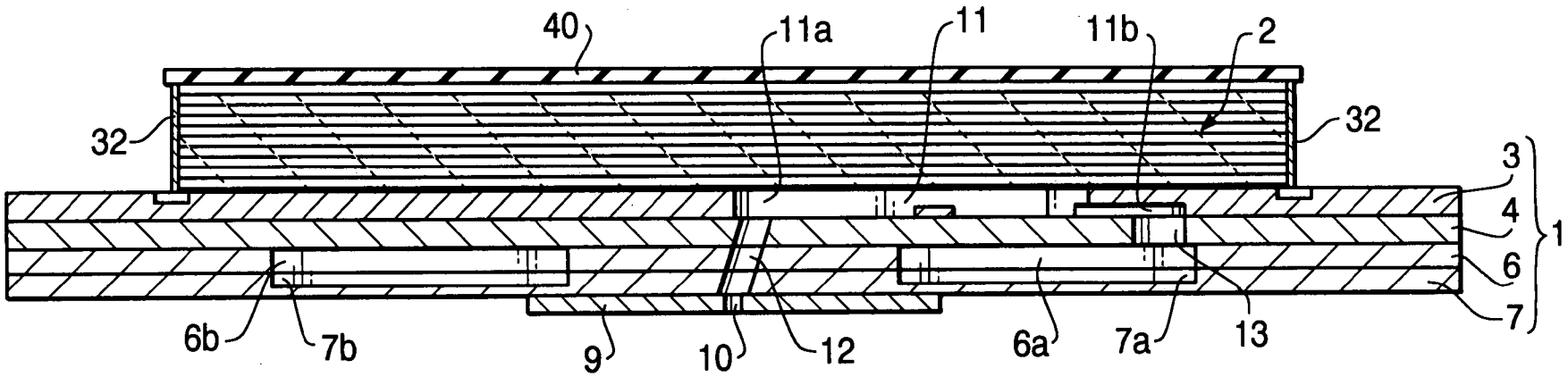
FIG. 5 is a sectional view of the ink-jet printhead shown in FIG. 2.

FIG. 4 is an enlarged perspective view of a part of the cavity unit 1 shown in FIG. 3, and FIG. 5 is a sectional view of the ink-jet printhead 100 shown in FIG. 2. As shown in FIG. 4, each of the pressure chambers 11 is formed long in the width direction of the cavity plate 3 and has a first end 11*a* and a second end 11*b* in the longitudinal direction thereof. The first end 11*a* of each pressure chamber 11 is connected with the corresponding nozzle orifice 10 through a corresponding one of a plurality of ink channels 12 formed in the cavity unit 1 in a staggered arrangement. Each ink channel 12 consists of through holes formed in the base plate 4 and the two manifold plates 6 and 7.

Each pressure chamber 11 is formed as an opening penetrating the cavity plate 3 except at the second end 11*b*, which is formed in a groove like form. Such a groove like form can be obtained, for example, by a half-etching process for forming the second end 11*b* at the middle of the cavity plate in the thickness direction. The second end 11*b* is formed in a groove like form so as to have a smaller cross section than the other part of the pressure chamber 11 and thereby serve as a flow restriction channel that restricts the amount of ink flowing into the pressure chamber 11.

The second end 11*b* of each pressure chamber 11 is in fluid communication with corresponding one of a pair of manifold chambers 60 through a corresponding one of a plurality of through holes 13 formed in the base plate 4 in the vicinities of the side edges 4*a* and 4*b* thereof.

Referring back to FIG. 3, the pair of manifold chambers 60, which serve as a pair of common ink chambers, are defined by a pair of openings (6*a*, 6*b*) of the manifold plate 6, which is placed nearer to the base plate 3 than the other manifold plate 7, and a pair of recesses (7*a*, 7*b*) of the other manifold plate 7.

The openings 6*a* and 6*b* are formed through the manifold plate 6 on both sides of the rows of the nozzle orifices 10 (or the rows of the ink channels 12). The recesses 7*a* and 7*b* are formed on the side of the manifold plate 7 facing the manifold plate 6 on both sides of the rows of the ink channels 12. The manifold chambers 60 obtained by overlaying the openings (6*a*, 6*b*) on the recesses (7*a*, 7*b*) have elongated shapes each extending along a respective one of the rows of the pressure chambers 11.

It should be noted that the upper side of the manifold chambers 60 (the upper side of the openings 6*a* and 6*b*) are closed by the undersurface of the base plate 4 that is bonded onto the top surface of the manifold plate 6 (see FIG. 5).

The cavity plate 3 is provided with a pair of ink supply holes 15*a*, 15*b* at one end in the longitudinal direction thereof. The base plate 4 is provided with a pair of ink supply holes 16*a*, 16*b* at one end in the longitudinal direction thereof. The pair of ink supply holes 15*a*, 15*b* are aligned with the ink supply holes 16*a*, 16*b*, in the direction in which the plates 3 through 9 are laminated, so as to form an ink supply channel that is in fluid communication with the pair of manifold chambers 60.

Ink is supplied from an external ink supply (not shown) into the pair of manifold chambers 60 through the ink supply holes 15*a*, 15*b*, 16*a* and 16*b*. The ink is then distributed to the pressure chambers 11 through the through holes 13 formed in the base plate 4. The ink further flows from each pressure chamber 11 into the corresponding ink channel 12 and finally reaches the corresponding nozzle orifice 10.

It should be noted that a filter 17 is attached on the top surface of the cavity plate 3 so as to cover the ink supply holes 15*a*, 15*b*. The filter 17 removes foreign matter from the ink flowing from the external ink supply into the cavity unit 1.

Figure 6:
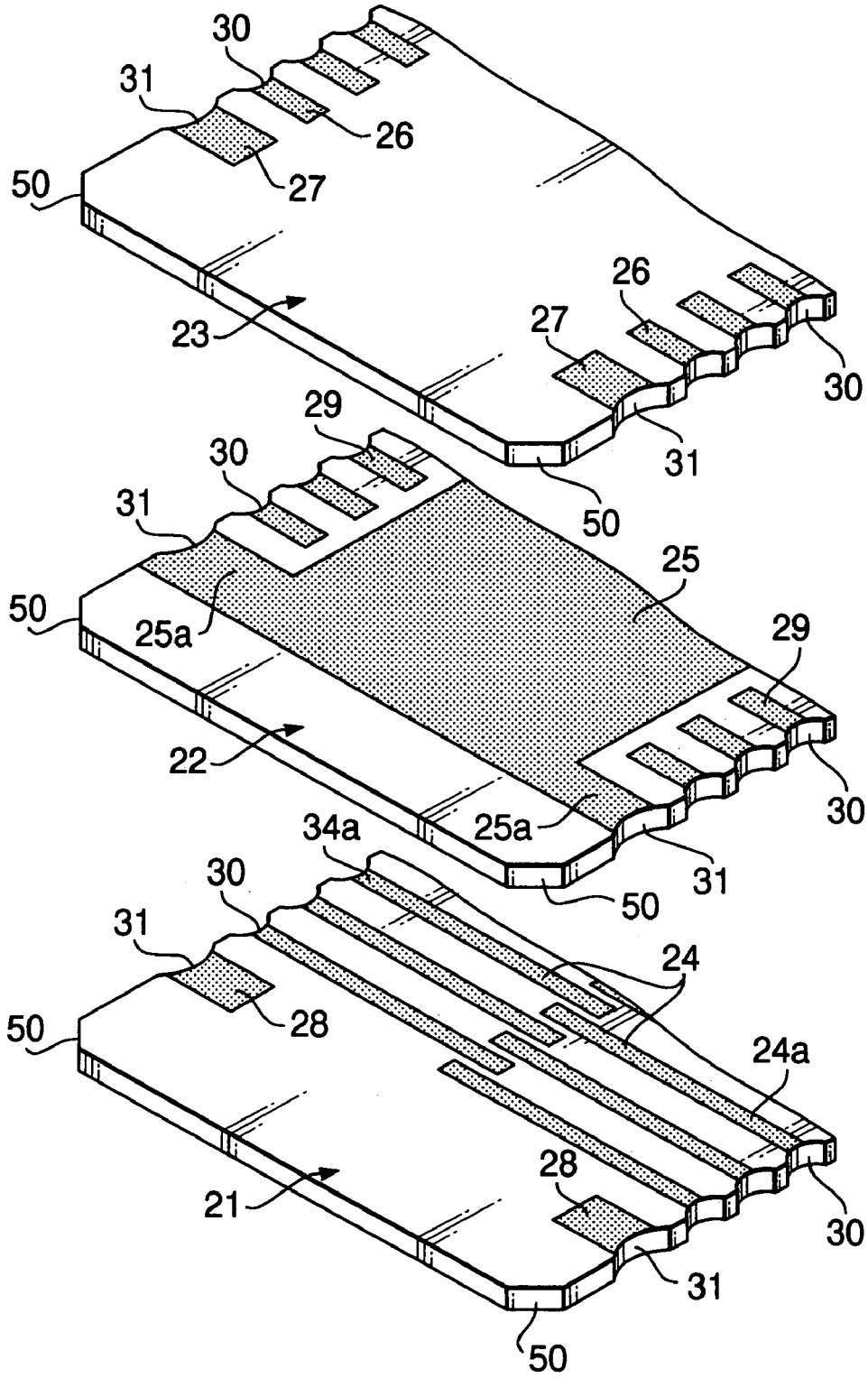
FIG. 6 shows an enlarged perspective view of a part of a piezoelectric actuator of the ink-jet printhead shown in FIG. 2.

As shown in FIG. 5, the piezoelectric actuator 2 includes a plurality of layers. FIG. 6 shows an enlarged perspective view of a part of the piezoelectric actuator 2. As with the piezoelectric actuators disclosed in Japanese Patent Publication Provisional Publications No. P2001-162796 and U.S. patent application Publication Ser. No. 2001/0,020,968 A1, the piezoelectric actuator 2 includes two types of piezoelectric sheets 21 and 22, which are stacked alternately, and an insulating sheet 23 which serves as the uppermost layer of the piezoelectric actuator 2. The piezoelectric sheets 21 and 22 are made of piezoelectric ceramic having a piezoelectric effect.

The upper surface of the first type piezoelectric sheet 21 is provided with two rows of staggered separate electrodes 24. The separate electrodes 24 are formed at positions corresponding to respective ones of the pressure chambers 11. Each separate electrode 24 is formed in an elongated shape with one end portion 24*a* thereof exposed on the side surface of the piezoelectric actuator 2, which side surface is perpendicular to the upper and lower surfaces of the actuator 2.

The second type piezoelectric sheet 22 has a common electrode 25 formed on the upper surface thereof. The common electrode 25 is common to all pressure chambers 11. The common electrode 25 is formed so that one or more end portions 25*a* thereof are exposed on the side surface of the piezoelectric actuator 2.

The first type piezoelectric sheet 21 is also provided with dummy electrodes 28 at positions corresponding to the end portions 25*a* of the common electrode 25 on the second type piezoelectric sheet 22. The end portion of each dummy electrode 28 is exposed to the side surface of the piezoelectric actuator 2. Likewise, the second type piezoelectric sheet 22 is also provided with dummy electrodes 29 at positions corresponding to the separate electrodes 24 on the first type piezoelectric sheet 21. The end portion of each dummy electrode 29 is exposed to the side surface of the piezoelectric actuator 2.

A plurality of the first and second type piezoelectric sheets 21 and 22 are stacked alternately so that each piezoelectric sheet is sandwiched between one common electrode 25 and the separate electrodes 24. The portion in each piezoelectric sheet (21, 22) defined between each separate electrode 24 and the common electrode 25 serves as an active portion that deforms if voltage is applied between the corresponding separate electrode 24 and the common electrode 25. The active portions are defined at positions corresponding to respective ones of the pressure chambers 11.

The insulating sheet 23 is provided with terminals 26 and 27 on the upper surface thereof. Each terminal 26 is electrically connected to the end portion of the corresponding separate electrode 24 and the end portion of the corresponding dummy electrode 29 through a side electrode 32. Likewise, each terminal 27 is electrically connected to the corresponding end portion of the common electrode 25 and the end portion of the corresponding dummy electrode 28 through a side electrode 33. The side electrodes 32 are formed on the side surfaces of the piezoelectric actuator 2 so as to extend in the vertical direction as shown in FIG. 5. The flexible flat cable is bonded to the upper surface of the piezoelectric actuator 2, or the upper surface of the insulating sheet 23, such that each line of the flexible flat cable 40 is electrically connected with respective one of the terminals 26 and 27.

As shown in FIG. 2, the piezoelectric actuator 2 has a substantially rectangular shape when observed from the top. Each corner 50 of the piezoelectric actuator 2 has a non-acute angle form such as an obtuse form (see FIG. 6), or a rounded convex form (see FIG. 7). In other words, portions having an angle of 90 degrees created by intersecting imaginary lines extended from two adjacent sides of the rectangular piezoelectric actuator 2 are removed.

Figure 8:
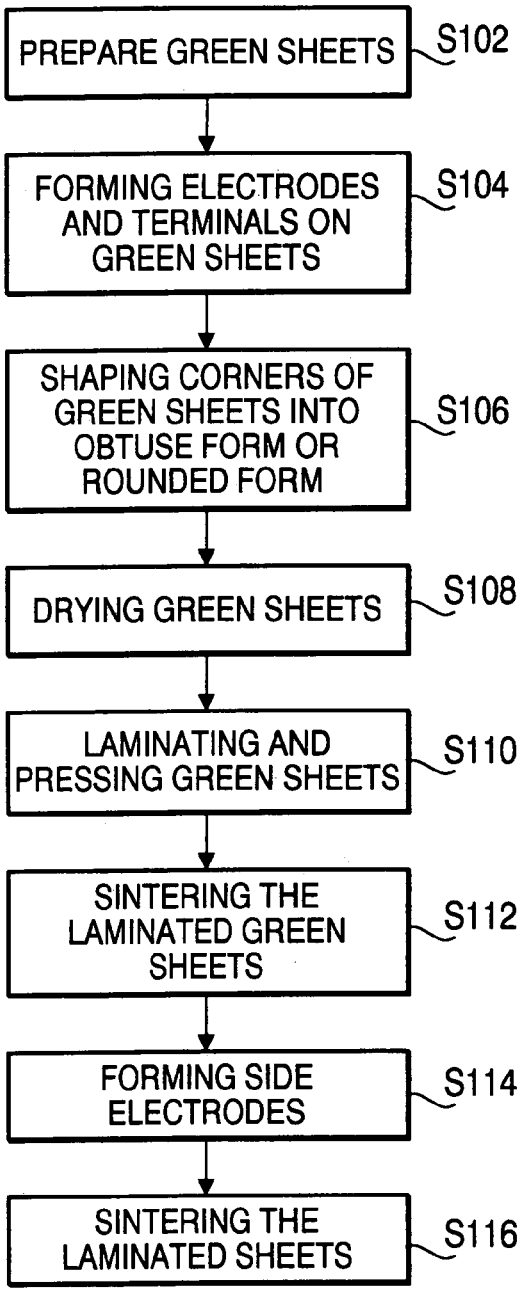
FIGS. 8 and 9 are flow charts showing processes for producing the piezoelectric actuator of the ink-jet printhead shown in FIG. 2.

Hereinafter, the process for producing the piezoelectric actuator 2 will be described with reference to FIG. 8.

First, at step S102, ceramic powder of lead zirconate titanate (PZT), which is a ferroelectric material and displays ferroelectricity when sintered as described later, is mixed with binder and solvent. The viscosity of the resultant mixture is adjusted to 10,000–30,000 CPS. Then, the mixture is spread over a film made of resin such as polyethylene terephthalate (PET), for example, to form elongated rectangular green sheets. Each green sheet has a thickness of about 30 μm and is provided with a plurality of grooves 30 and grooves 31 at the right and left side surfaces thereof (see FIGS. 6 and 7). The grooves 30 and 31 are formed so as to extend in the thickness direction of the green sheet.

Next, at step S104, the separate electrodes 24 and the dummy electrodes 28 are formed on the upper surface of each green sheet to be used as the first type piezoelectric sheet 21. The separate electrodes 24 and the dummy electrodes 28 are formed by printing conductive paste (metallic material) on the green sheets. In the meanwhile, the common electrode 25 and the dummy electrodes 29 are formed on the upper surface of each green sheet to be used as the second type piezoelectric sheet 22 by printing conductive paste thereon. Similarly, the terminals 26, 27 are formed on the upper surface of the green sheet to be used as the insulating sheet (top sheet) 23 by printing conductive paste thereon.

Figure 7:
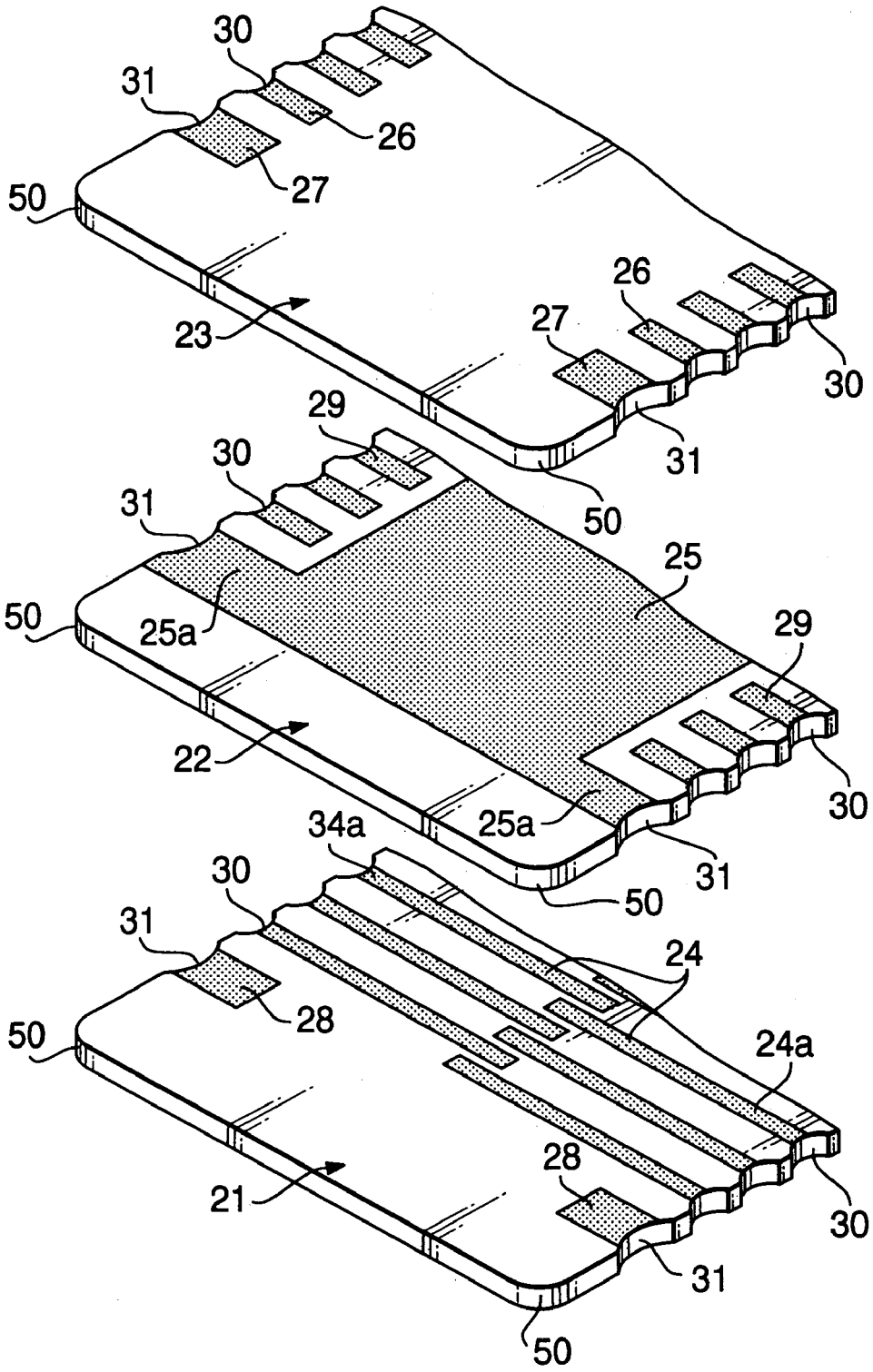
FIG. 7 shows an enlarged perspective view of a part of an modified piezoelectric actuator of the ink-jet printhead shown in FIG. 2.

As shown in FIGS. 6 and 7, the separate electrodes 24, the dummy electrodes 29, and the terminals 26 are formed such that the outer ends thereof are exposed on respective ones of the grooves 30. Each common electrode 25 is formed so that the end portions 25*a* thereof are exposed on the grooves 31. The dummy electrodes 28 and the terminals 27 have their outer ends being exposed on the grooves 31, too.

Figure 9:
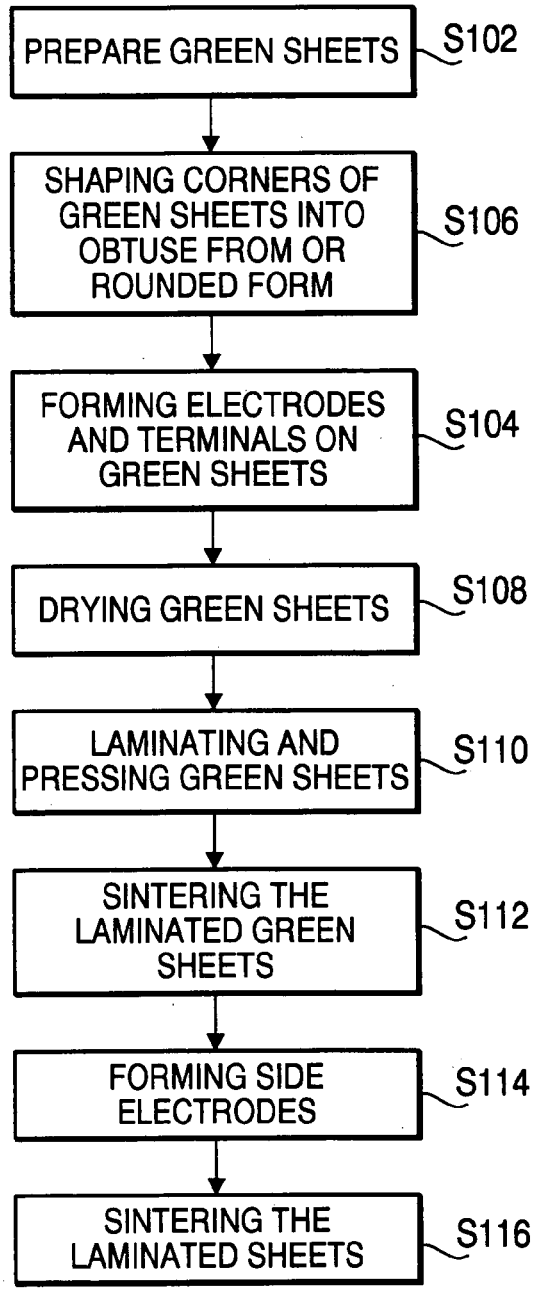

Referring back to FIG. 8, at step S106, each corner of each green sheet is cut off into an obtuse form (see FIG. 6), or rounded into a convex form (see FIG. 7). As shown in FIG. 6, each 90 degree corner of each green sheet is cut along a line intersecting the corresponding two adjacent sides of the green sheet that create the 90 degree corner such that the line and the corresponding two adjacent sides create two obtuse angles. Alternatively, as shown in FIG. 7, each 90 degree corner of each green sheet is rounded into a corner curved convexedly on an appropriate radius, or an arc of 90 degrees. It should be noted, however, that this step (S106) may be performed before printing the electrodes and terminals on the green sheets at step 104, as shown in FIG. 9, instead of after step 104.

Next, the green sheets are dried (S108). At step 110, the green sheets corresponding to the piezoelectric sheets 21 and 22 are laminated alternately and the green sheet corresponding to the insulating sheet (top sheet) 23 is placed on the top thereof. Then the laminated green sheets are integrated by pressing them in the laminated direction.

Then, the laminated green sheets are sintered (S112). Next, the side electrodes 32 and 33 are formed by printing conductive paste (metallic material) along the grooves 30 and 31, or in the direction the green sheets are laminated (S114). At last, the laminated green sheets are sintered again (S116) and the piezoelectric actuator 2 is obtained.

It should be noted that each of the green sheets may be formed in a size large enough to define a plurality of areas thereon, each corresponding to a single piezoelectric sheet (21, 22) or an insulating sheet 23. In this case, the electrodes and terminal patterns are printed on each of the areas defined on the large size green sheets. Then, the large size green sheets are laminated and dried, and then cut into a plurality of pieces, each corresponding to a single piezoelectric actuator 2. Then, the laminated pieces are sintered, and the side electrodes 32 and 33 are printed on the side surfaces of each piece. At last, the laminated pieces are sintered again. If the piezoelectric actuator 2 is produced in such a manner, the corners of the piezoelectric actuator 2 may be shaped into an obtuse or rounded form after the laminated sheets are cut into the plurality of pieces but still not sintered.

As described above, each corner 50 of each rectangular green sheet is cut into an obtuse form or a rounded convex form before the green sheet is sintered. The obtuse or rounded form prevents the corners of the laminated ceramic sheets (the corners of the piezoelectric actuator 2) from becoming warped due to sintering, and thereby secures the flatness of the piezoelectric actuator 2.

The piezoelectric actuator 2 is placed on the top surface of the cavity unit 1 with a thermosetting adhesive layer therebetween and pressed against the cavity unit 1 to be fixed on it. Since the corners of the piezoelectric actuator 2 are flat, the corners will not be subjected to high mechanical stress, which may produce cracks in the corners, at the time the piezoelectric actuator 2 is pressed against the cavity unit 1. Further, the flat corners of the piezoelectric actuator 2 prevent the pressure chambers 11 of the cavity plate 3 from being unsealed due to insufficient bonding of the piezoelectric actuator 2 onto the top surface of the cavity unit 1.

The plate type piezoelectric actuator 2 is fixed onto the top surface of the cavity unit 1 in such a manner that the separate electrodes 24 are positioned above respective ones of the pressure chambers 11 of the cavity unit 1. Further, the flexible flat cable 40 is bonded onto the top surface of the piezoelectric actuator 2 so that the lines of the flexible flat cable 40 are electrically connected with respective ones of the terminals 26 and 27 of the piezoelectric actuator.

In the piezoelectric actuator 2 configured as above, voltage can be selectively applied between each separate electrode 24 and the common electrode 25. If the voltage is applied, the active portion defined between the selected separate electrode 24 and the common electrode 25 deforms in the ceramic sheets laminated direction due to a piezoelectric effect. The deformation of the active portion causes volume reduction of the pressure chamber 11 that is located below the active portion, or the selected separate electrode 24. As a result, the ink within this pressure chamber 11 is pressed to eject from the nozzle orifice 10. In this manner, printing is carried out with the ink-jet printhead 1.

The present disclosure relates to the subject matter contained in Japanese Patent Application No. P2002-282392, filed on Sep. 27, 2002, which is expressly incorporated herein by reference in its entirety.

What is claimed is:

1. An ink-jet printhead, comprising:

a cavity unit having a plurality of nozzle orifices and a plurality of pressure chambers, the pressure chambers storing ink and being in fluid communication with the respective nozzle orifices; and a plate type piezoelectric actuator having outer peripheral corners, the plate type piezoelectric actuator overlaid on the cavity unit, the piezoelectric actuator selectively applying pressure to the pressure chambers to eject the ink from the respective nozzle orifices, the outer peripheral corners of the plate type piezoelectric actuator being shaped into a non-acute and non-right angle form.

2. The ink-jet printhead according to claim 1, wherein the cavity unit is formed with openings at one face thereof to define the pressure chambers, and wherein the piezoelectric actuator is overlaid on the one face of the cavity unit to seal the openings.

3. The ink-jet printhead according to claim 2, wherein the piezoelectric actuator is fixed to the one face of the cavity unit by means of a thermosetting adhesive.

4. The ink-jet printhead according to claim 1, wherein the piezoelectric actuator has a rectangular shape, and four corners of the piezoelectric actuator are shaped into one of an obtuse form and a rounded convex form.

5. The ink-jet printhead according to claim 4, wherein the piezoelectric actuator includes a laminate of a plurality of piezoelectric sheets, corners of each of the piezoelectric sheets being shaped into one of the obtuse form and the round convex form.

6. The ink-jet printhead according to claim 5, wherein the piezoelectric actuator further includes an insulative sheet placed on the top of the laminate of piezoelectric sheets, corners of the insulative sheet being shaped into one of the obtuse form and the round convex form.

7. The ink-jet print head according to claim 6, the insulative sheet is made of the same material as the piezoelectric sheets.

8. The ink-jet printhead according to claim 1, wherein the plurality of nozzle orifices are arranged in a row and the plurality of pressure chambers are arranged in a row, and wherein the piezoelectric actuator has a plurality of active portions aligned with the respective pressure chambers.

9. The ink-jet printhead according to claim 8, wherein the piezoelectric actuator is a laminate of first and second electrode layers and a piezoelectric sheet interposed between the first and second electrode layers, and the first electrode layer includes a plurality of separate electrodes that define together with the second electrode layer the plurality of active portions in the piezoelectric sheet, corners of the piezoelectric sheet being shaped into one of the obtuse form and the rounded convex form.

10. An ink-jet printhead, comprising:

a cavity unit having a plurality of nozzle orifices and a plurality of pressure chambers, the pressure chambers storing ink and being in fluid communication with the respective nozzle orifices; and a plate type piezoelectric actuator overlaid on the cavity unit, the piezoelectric actuator selectively applying pressure to the pressure chambers to eject the ink from the respective nozzle orifices, the plate type piezoelectric actuator having a substantially rectangular shape, wherein each outer peripheral corner is one of obtuse and round.

11. The ink-jet printhead according to claim 10, wherein all corners are rounded.

12. The ink-jet printhead according to claim 10, wherein each angle formed by the obtuse corner is equal.

13. The ink-jet printhead according to claim 10, wherein angles formed by the obtuse corner are not equal.

* * * * *